US011918077B2

(12) United States Patent
Grady

(10) Patent No.: US 11,918,077 B2
(45) Date of Patent: Mar. 5, 2024

(54) SHOE PROTECTORS

(71) Applicant: Angela Grady, Griffin, GA (US)

(72) Inventor: Angela Grady, Griffin, GA (US)

( * ) Notice: Subject to any disclaimer, the term of this patent is extended or adjusted under 35 U.S.C. 154(b) by 0 days.

(21) Appl. No.: 17/842,677

(22) Filed: Jun. 16, 2022

(65) Prior Publication Data

US 2023/0404212 A1 Dec. 21, 2023

(51) Int. Cl.
*A43B 23/30* (2006.01)

(52) U.S. Cl.
CPC ..... *A43B 23/30* (2013.01)

(58) Field of Classification Search
CPC ..... A43B 23/30; A43C 19/00
USPC ..... 36/132, 136, 2 R, 70 R, 72 B; D2/964–966, 897, 925, 953, 915, 976
See application file for complete search history.

(56) References Cited

U.S. PATENT DOCUMENTS 1,769,758 A * 7/1930 Siese, Jr. ..... A43B 5/007 36/72 B
1,770,261 A * 7/1930 Barthes ..... A43B 23/30 D2/915
2,039,954 A * 5/1936 Fricker ..... A43B 3/166 36/70 R
3,063,172 A * 11/1962 Beattie ..... A43B 23/30 D2/915
3,077,679 A * 2/1963 Hanko ..... A43B 3/16 36/7.1 A
3,239,953 A * 3/1966 Norton ..... A43B 23/30 36/72 B
4,750,278 A * 6/1988 Cates ..... A43B 23/30 36/72 B
4,756,097 A * 7/1988 Sanders ..... A43B 5/007 36/72 B
4,794,705 A * 1/1989 Sanders ..... A43B 23/30 36/72 B
5,052,129 A * 10/1991 Lobasso ..... A43C 13/00 36/73
5,357,694 A * 10/1994 Mauck ..... H04N 9/31 36/72 B (Continued)

FOREIGN PATENT DOCUMENTS

BR 102018014960 A2 2/2020
FR 2618058 A1 1/1989

(Continued)

OTHER PUBLICATIONS

Amazon Fashion, GoGoHeel Quick Tips—The Original High Heel Protector & Heel Repair Caps (accessed via https://www.amazon.com/QUICK-TIPS-Heel-Protector-Repair/dp/B011WL8CZA/ref=sr_1_6?crid=36GYEW8AJIZS5&dchild=1&keywords=heel+covers+for+high+heel+shoes&qid=1600861872&sprefix=heel+co%2Caps%2C192&sr=8-6) (Dec. 5, 2019).

(Continued)

*Primary Examiner* — Ted Kavanaugh
(74) *Attorney, Agent, or Firm* — TROUTMAN PEPPER HAMILTON SANDERS LLP; John A. Morrissett; Celeste K. Walker

(57) ABSTRACT

A shoe protector may be configured to removably adhere to a back portion of a shoe. The shoe protector may include a plurality of panels extending outwardly from the back portion of the shoe. The plurality of panels may include one or more flat panels each configured approximately parallel to the back portion of the shoe, and one or more angled panels each configured at a respective angle relative to the back portion of the shoe.

10 Claims, 6 Drawing Sheets

(56) References Cited

U.S. PATENT DOCUMENTS

| | | | | |
|---|---|---|---|---|
| 5,606,808 | A * | 3/1997 | Gilliard | A43B 5/0401 36/89 |
| 5,771,607 | A | 6/1998 | Dean | |
| D575,490 | S * | 8/2008 | Hatfield | D2/969 |
| 7,730,638 | B2 | 6/2010 | Urbach et al. | |
| 7,814,685 | B1 * | 10/2010 | Tankson | A43B 5/007 36/72 B |
| 8,141,275 | B1 * | 3/2012 | Donaldson | A43B 21/22 D2/915 |
| 8,667,712 | B2 * | 3/2014 | Baum | A43B 1/0027 36/72 B |
| D793,056 | S * | 8/2017 | Venturi | D2/965 |
| D880,136 | S * | 4/2020 | Cristobal | D2/972 |
| 2004/0025379 | A1 * | 2/2004 | McDowell | A43B 23/30 36/72 B |
| 2005/0198872 | A1 * | 9/2005 | Correa | F41C 33/041 36/136 |
| 2006/0096127 | A1 * | 5/2006 | McAllister | A43B 23/30 36/72 B |
| 2008/0115387 | A1 * | 5/2008 | Walworth | A43B 7/32 36/77 R |
| 2012/0198731 | A1 | 8/2012 | Barge | |
| 2014/0082973 | A1 * | 3/2014 | Raymer, Jr. | A43C 19/00 36/70 R |
| 2016/0249708 | A1 * | 9/2016 | Boag | A43B 3/16 36/72 B |
| 2016/0345679 | A1 * | 12/2016 | Beers | A43B 19/00 |
| 2017/0042292 | A1 | 2/2017 | Ghirda | |
| 2018/0049495 | A1 * | 2/2018 | Creason | A41F 17/02 |

FOREIGN PATENT DOCUMENTS

| | | | |
|---|---|---|---|
| GB | 2171588 | A | 9/1986 |
| GB | 2245146 | A | 1/1992 |
| WO | 2013006850 | A3 | 1/2013 |

OTHER PUBLICATIONS

Amazon.com, Solemates High Heel Protectors (accessed via https://www.amazon.com/QUICK-TIPS-Heel-Protector-Repair/dp/B011WL8CZA/ref=sr_1_6?crid=36GYEW8AJIZS5&dchild=1&keywords=heel+covers+for+high+heel+shoes&qid=1600861872&sprefix=heel+co%2Caps%2C192&sr=8-6) (Aug. 30, 2011).

Amazon.com, CoveredSole Stem Shield (accessed via https://www.amazon.com/CoveredSole-Stem-Shield-Pairs-Protector/dp/B08M4K2CMG/ref=asc_df_B08M4K2CMG/?tag=hyprod-20&linkCode=df0&hvadid=475739748864&hvpos=&hvnetw=g&hvrand=17240252905188698312&hvpone=&hvptwo=&hvqmt=&hvdev=c&hvdvcmdl=&hvlocint=&hvlocphy=9008464&hvtargid=pla-1086864593508&psc=1) (Oct. 28, 2020).

* cited by examiner

SHOE PROTECTORS

The disclosed technology generally relates to shoe protectors, and more particularly to shoe protectors configured to protect the backs and heels of various shoe types when worn while driving a vehicle.

BACKGROUND

The heels or back portions of shoes tend to scuff or wear when worn while driving a vehicle. A driver typically rests the back portion of his or her shoe on the floor of the vehicle (e.g., a car), turning the shoe either from side to side or up and down depending on what action the driver is taking, such as pressing down or letting up on the accelerator, break, or clutch. To avoid scuffing a shoe, a driver may take the shoe off and drive the vehicle barefoot. This action, however, can prove uncomfortable to the driver or even unsafe given reduced traction between a foot, either bare or in a sock, and the vehicle pedals.

Accordingly, there is a need for improved shoe protectors. Embodiments of the present disclosure are directed to this and other considerations.

SUMMARY

Disclosed embodiments may include a shoe protector configured to removably adhere to a back portion of a shoe. The shoe protector may include a plurality of panels extending outwardly from the back portion of the shoe. The plurality of panels may include one or more flat panels each configured approximately parallel to the back portion of the shoe. The plurality of panels may further include one or more angled panels each configured at a respective angle relative to the back portion of the shoe.

In some embodiments, the shoe protector may include a heel cover configured to engage with a first portion of a heel of the shoe.

In some embodiments, the shoe protector may include a cap configured to engage with a bottom end of the heel of the shoe.

In some embodiments, the shoe protector may include a clip configured to attach to and extend from a first edge of the plurality of panels and removably attach to a collar of the shoe behind a heel of the user.

Further implementations, features, and aspects of the disclosed technology, and the advantages offered thereby, are described in greater detail hereinafter, and can be understood with reference to the following detailed description, accompanying drawings, and claims.

BRIEF DESCRIPTION OF THE DRAWINGS

Reference will now be made to the accompanying drawings, which are not necessarily drawn to scale, and which illustrate various implementations, aspects, and principles of the disclosed technology. In the drawings.

DETAILED DESCRIPTION

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Many suitable components that would perform the same or similar functions as components described herein are intended to be embraced within the scope of the disclosed devices and methods. Such other components not described herein may include, but are not limited to, for example, components developed after development of the disclosed technology.

Reference will now be made in detail to exemplary embodiments of the disclosed technology, examples of which are illustrated in the accompanying drawings and disclosed herein. Wherever convenient, the same reference numbers will be used throughout the drawings to refer to the same or like parts.

Figure 1B:
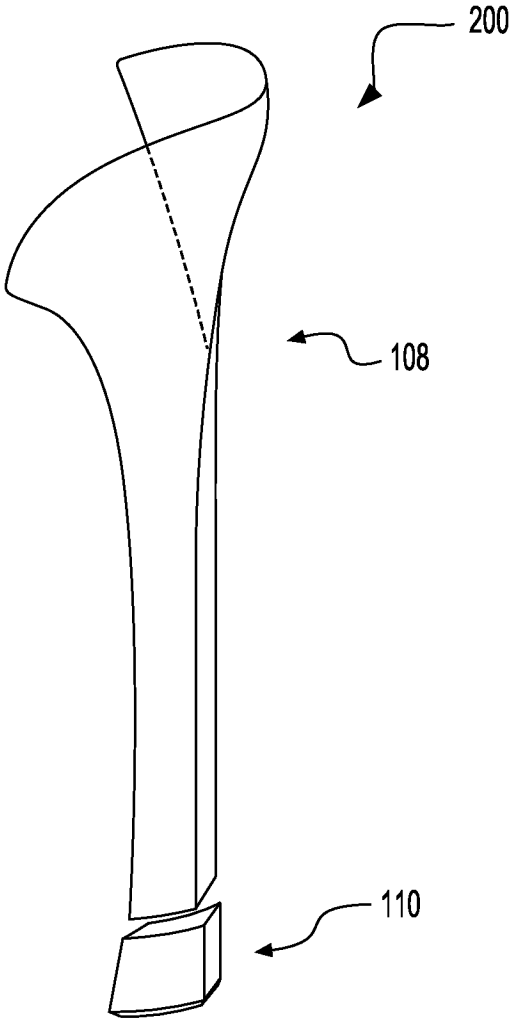
FIG. 1B is a perspective view of a shoe protector according to certain embodiments of the present disclosure.
Figure 1A:
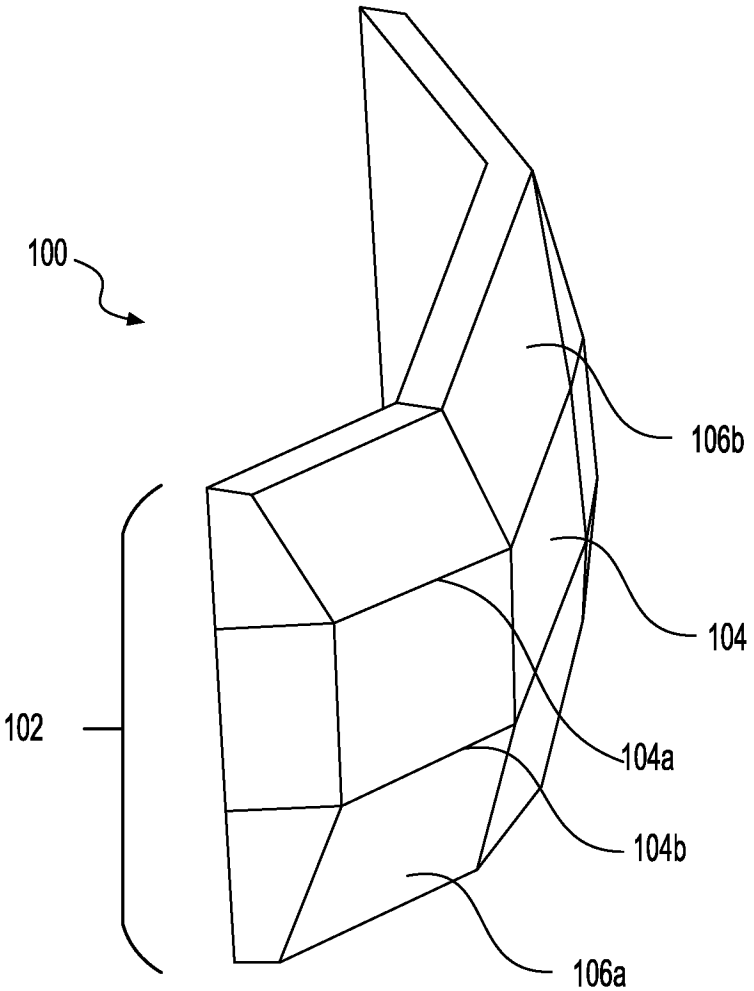
FIG. 1A is a perspective view of a shoe protector according to certain embodiments of the present disclosure.

FIG. 1A provides a perspective view of a shoe protector 100 according to certain embodiments of the present disclosure. The shoe protector 100 may be configured to removably adhere to a back portion of a shoe 10, such as a heel (e.g., FIG. 2A). Shoe 10 may include a flat shoe, such as a sneaker or loafer (e.g., FIG. 3), or a high heel, such as a stiletto or boot (e.g., FIGS. 2A-2B). Shoe protector 100 may be made from a variety of materials (e.g., foam, gel, cork, leather, felt, terrycloth, etc.), and may include an adhesive material (e.g., silicone, polyurethane, gel, etc.) on at least one side such that shoe protector 100 may removably adhere to the back portion of the shoe 10. The adhesive material used may be of a type that can be removed and re-applied such that shoe protector 100 may be taken on and off a shoe 10 without leaving behind a film or other residue on the shoe 10. Additionally, shoe protector 100 may be configured for repeated use.

Shoe protector 100 may include a plurality of panels 102 extending outwardly from the back portion of the shoe 10. The plurality of panels 102 may include one or more flat panels 104 each configured approximately parallel to the back portion of the shoe 10, as further discussed below. The plurality of panels 102 may further include one or more angled panels 106*a* and/or 106*b*, each configured at a respective angle relative to the back portion of the shoe 10, as further discussed below. In some embodiments, angled panel(s) 106*a* may be configured as a row of panels along the bottom of shoe protector 100, extending upwards and meeting a bottom edge 104*b* of the flat panel(s) 104. In some embodiments, angled panel(s) 106*b* may be configured as a row of panels along the top of shoe protector 100, extending downwards and meeting a top edge 104*a* of the flat panel(s) 104. In some embodiments, angled panel(s) 106*a* and 106*b* may be configured as a mirror image of each other.

As disclosed herein, shoe protector 100 may be used in conjunction with a shoe 10 while a user is driving a vehicle. In such case, the plurality of panels 102 may provide a benefit of enabling the user to keep his/her foot stable, due to the variety of flat panels as opposed to curved surfaces, as the user shifts his/her foot from one position to another, as further discussed below.

FIG. 1B provides a perspective view of a shoe protector 200 according to certain embodiments of the present disclosure. Similar to shoe protector 100 of FIG. 1A, one or more components of shoe protector 200 may be configured to removably adhere to a back portion (e.g., a heel) of a shoe 10, such as a stiletto or other type of high heel, and for repeated use. Shoe protector 200 may include a heel cover 108 configured to engage with a first portion of a heel of the shoe 10, and a cap 110 configured to engage with a bottom end of the heel of the shoe 10, as further discussed below.

Figure 2A:
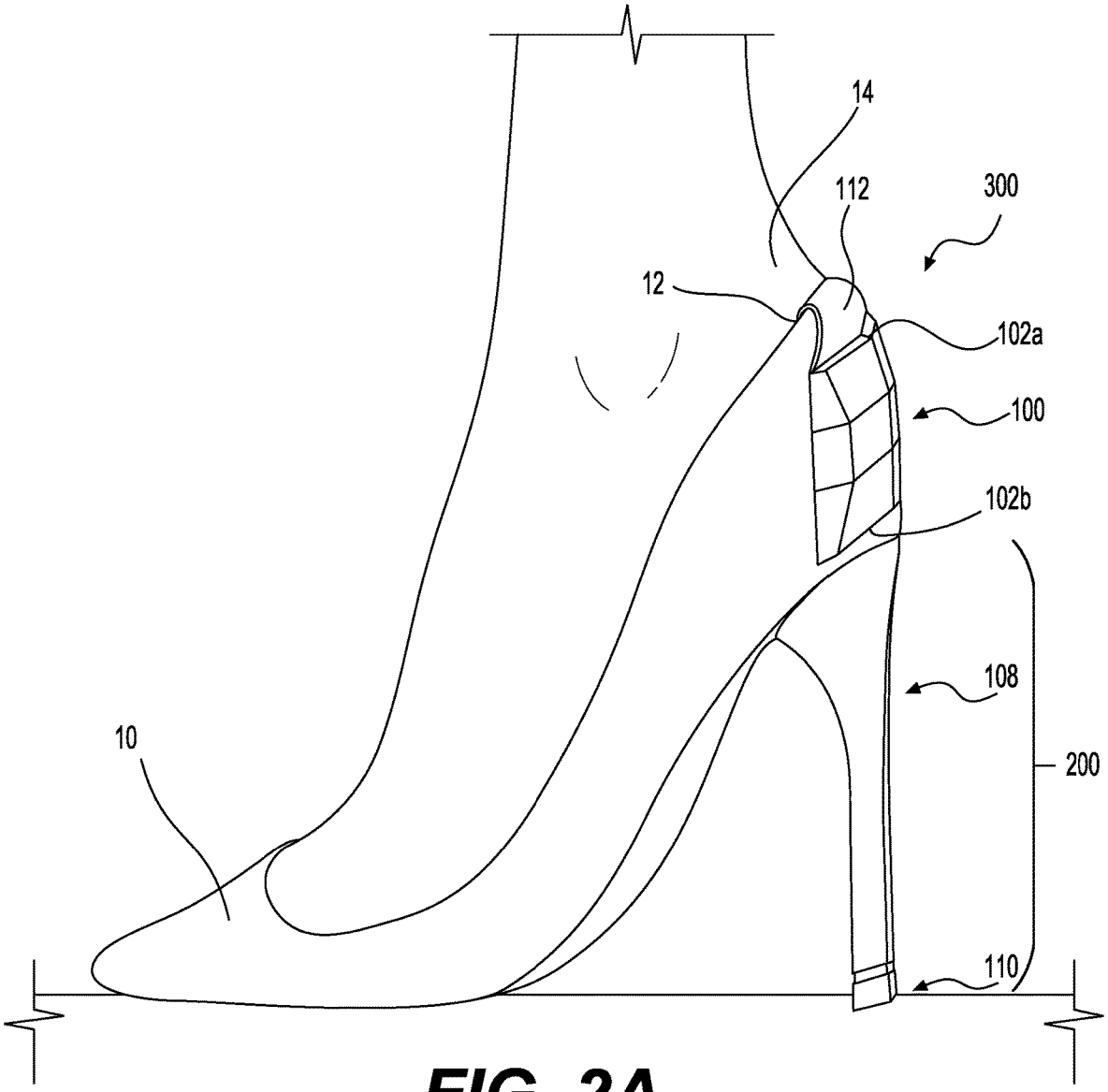
FIG. 2A is a perspective view of a shoe protector used in conjunction with a stiletto shoe according to certain embodiments of the present disclosure.

FIG. 2A provides a perspective view of a shoe protector 300 according to certain embodiments of the present disclosure. Shoe protector 300 may include shoe protectors 100 (FIG. 1A) and 200 (FIG. 1B) used in conjunction with a stiletto shoe 10 according to certain embodiments of the present disclosure. As illustrated, shoe protector 100 may be positioned along the outside upper heel portion of the stiletto shoe 10, and may be centered such that shoe protector 100 wraps evenly around the upper heel of the shoe 10. At the same time, shoe protector 200 may be positioned such that the heel cover 108 is positioned along the lower heel, and the cap 110 is fitted onto the bottom end or tip of the heel. Similar to shoe protector 100, heel cover 108 of shoe protector 200 may include an adhesive material (e.g., silicone, polyurethane, gel, etc.) on at least one side such that heel cover 108 may adhere to the lower heel portion of the shoe 10. In some embodiments, heel cover 108 may be configured similar to a sticker, wherein a paper (or other material) flap may be peeled away, exposing an adhesive side of heel cover 108 such that heel cover 108 may be centered and evenly wrapped around and adhered to the lower heel of the shoe 10. In some embodiments, heel cover 108 may be made in a variety of colors, such as black, white, clear, red, etc., such that a user may decide which color matches or blends best with the color of the lower heel and/or shoe 10 being worn.

Cap 110 may be configured in a variety of shapes and/or sizes such that a user may select which cap 110 best fits onto the bottom end or tip of the heel. For example, the cap 110 may be configured in a square or circular shape depending on the shape of the bottom end of the heel of the shoe 10. Cap 110 may be made of a tougher material, such as plastic or rubber, such that it can withstand the weight of a user while protecting the bottom end of the heel.

In some embodiments, shoe protector 300 may include a clip 112 configured to attach to and extend from a top edge 102*a* of shoe protector 100. Clip 112 may be configured to removably attach to a collar 12 of the shoe 10 behind a heel 14 of a user. Clip 112 may be made of a variety of materials, such as plastic, rubber, cork, felt, terrycloth, etc. Clip 112 may be configured to have a rigid structure for clipping or hanging onto the collar 12 of the shoe 10, or may be configured to have a softer and/or stretchy structure for wrapping around the top of the collar 12. In some embodiments, clip 112, like shoe protectors 100 and 200, may include an adhesive material (e.g., silicone, polyurethane, gel, etc.) on at least one side such that clip 112 may adhere to the collar 12 of the shoe 10. The clip 112 may provide additional support to help ensure shoe protector 100, 200, and/or 300 remains in place.

Figure 2B:
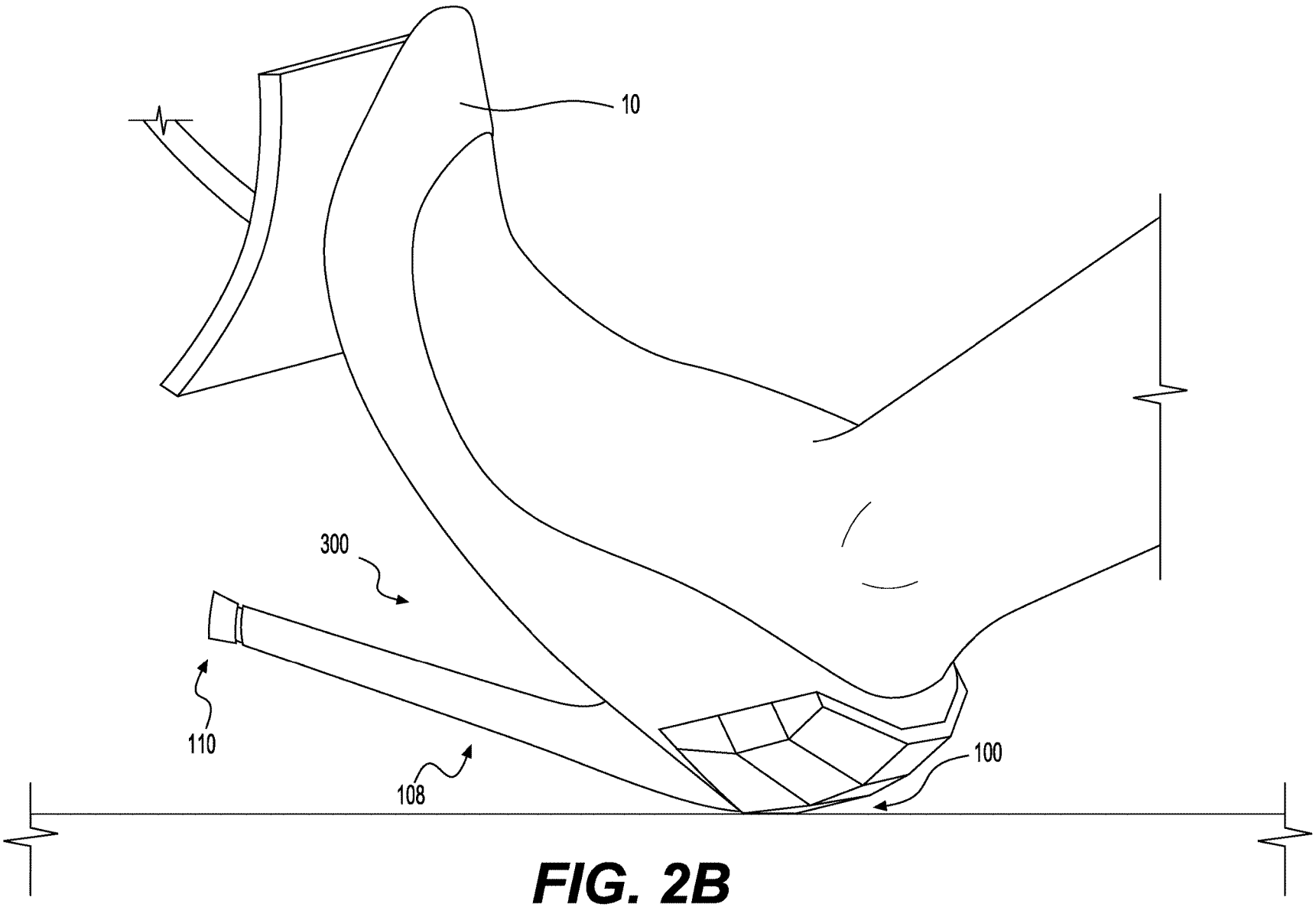
FIG. 2B is a perspective view of the shoe protector of FIG. 2B used in conjunction with a stiletto shoe according to certain embodiments of the present disclosure.

FIG. 2B provides another perspective view of shoe protector 300 according to certain embodiments of the present disclosure. A user of shoe protector 300 (or 100 and/or 200) may use shoe protector 300 while driving a vehicle. In such case, the plurality of panels 102 of shoe protector 100 may be configured to engage with the ground (e.g., the floor of the vehicle) to prevent the heel of shoe 10 from getting scuffed or scratched, as further discussed below. At the same time, heel cover 108 and/or cap 112 may provide additional coverage to prevent a lower heel and/or heel end of a high heel (e.g., a stiletto) from getting scuffed or scratched.

As discussed herein, the plurality of panels 102 having a variety of flat panels with respect to the floor of the vehicle, may enable the user to shift his/her foot between positions (e.g., stepping on the brake versus the accelerator pedal) safely and securely, while helping to decrease unnecessary motion or rotation of the shoe 10, and thereby wear and tear of the shoe 10. That is, rather than a curved surface that may case a user to mistakenly rotate or swivel shoe 10 from one position to another, the configuration of plurality of panels 102 may enable the user to keep shoe steady no matter what angle or position shoe 10 may be in with respect to the vehicle floor and/or pedals, as further discussed below.

Figure 3:
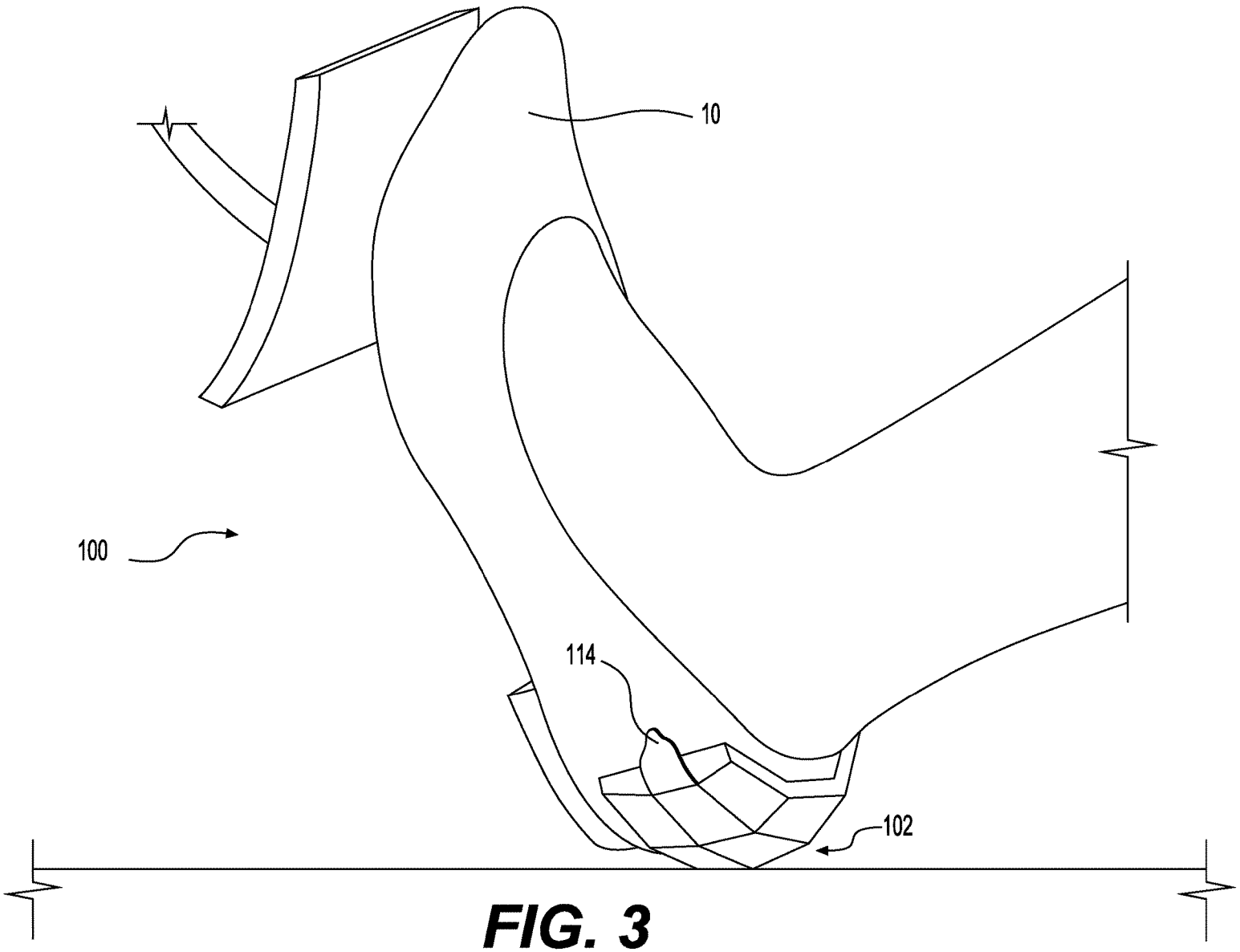
FIG. 3 is a perspective view of the shoe protector of FIG. 1A used in conjunction with a flat shoe according to certain embodiments of the present disclosure.

FIG. 3 provides another perspective view of shoe protector 100 according to certain embodiments of the present disclosure. Shoe protector 100 may be used in conjunction with a flat type of shoe 10, such as a sneaker, loafer, etc., and may help to prevent the heel of shoe 10 from getting scuffed or scratched while being worn while driving a vehicle, as further discussed below. In some embodiments, as shown in FIG. 3, shoe protector 100 may include a tab 114 configured to aid in removal of shoe protector 100 from the heel of the shoe. Those of ordinary skill in the pertinent art will appreciate that tab 114 may be configured to engage with any edge and/or face of shoe protector 100 and be configured to aid a user in removing or peeling shoe protector 100 away from the back or heel of shoe 10. Tab 114 may be configured in a variety of shapes and/or sizes, and may be made of a variety of materials, such as plastic, rubber, cork, leather, terrycloth, felt, etc.

Figure 4:
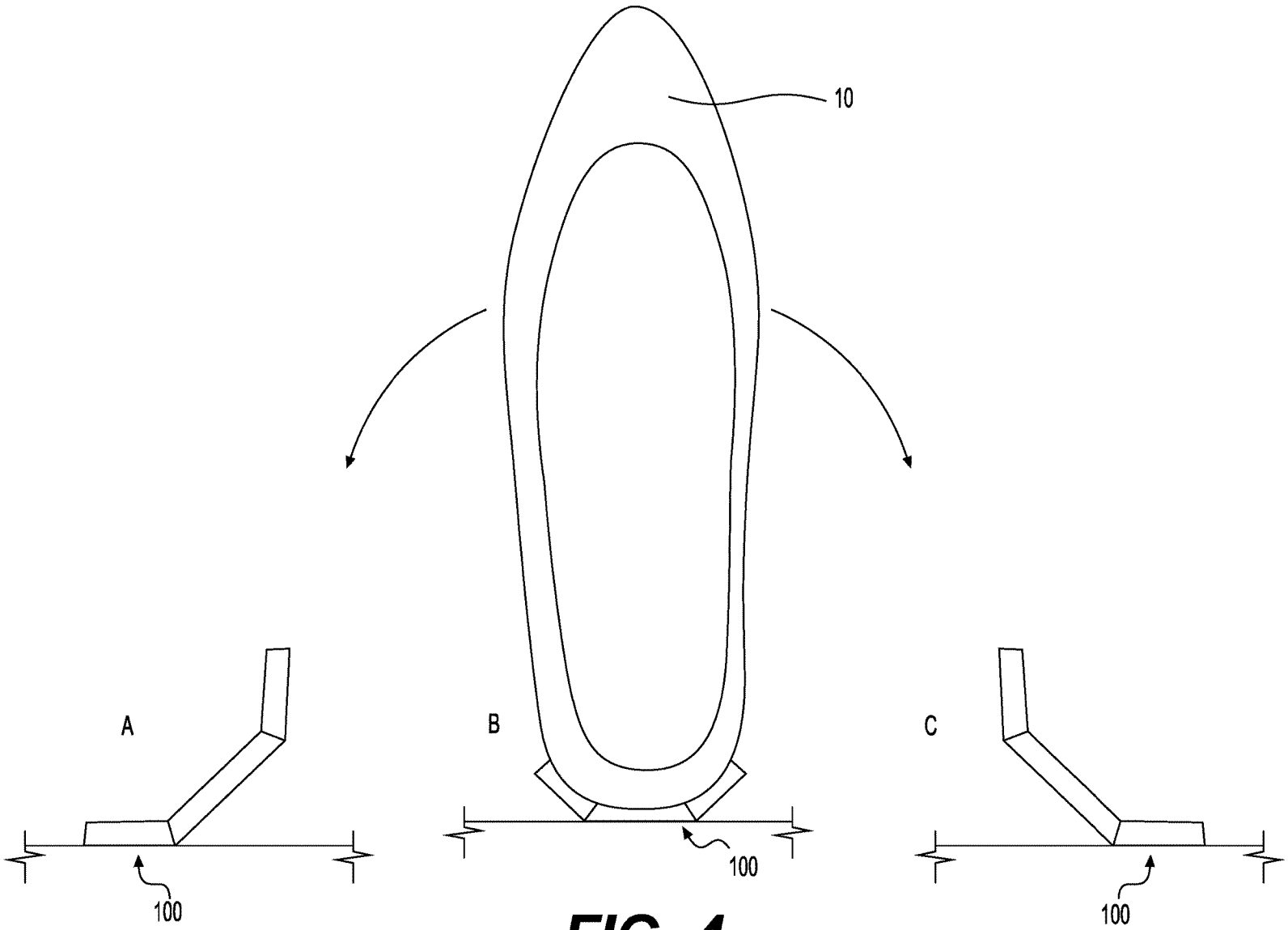
FIG. 4 is a top view of the shoe protector of FIG. 1A used in conjunction with a shoe according to certain embodiments of the present disclosure.

FIG. 4 is a top view of shoe protector 100 used in conjunction with a shoe 10 according to certain embodiments of the present disclosure. FIG. 4 provides an example of how shoe protector 100 may engage with the ground, such as the floor of a vehicle, when shoe protector 100 is used on shoe 10 while a user is driving a vehicle. For example, while driving, a wearer of shoe 10 may have his or her heel resting on the floor of the vehicle, and may move shoe 10 between positions A, B, and/or C, e.g., from side to side, when performing certain actions, such as shifting his or her foot between the clutch, accelerator, and/or brake pedal.

In some embodiments, when shifting from a first position to a second position, e.g., position A to position B, position B to position C, etc., a first flat panel of the flat panel(s) 104 may engage with the ground while shoe 10 is in the first position, while a second flat panel of the flat panel(s) 104 may engage with the ground while shoe 10 is in the second position. In some embodiments, when shifting from a first to a second position, a first angled panel of the angled panels(s) 106*a* may engage with the ground while shoe 10 is in the first position, while a second angled panel of the angled panel(s) 106*a* may engage with the ground while shoe 10 is in the second position. In still other embodiments, when shifting from a first to a second position, a first angled panel of the angled panels(s) 106*b* may engage with the ground while shoe 10 is in the first position, while a second angled panel of the angled panel(s) 106*b* may engage with the ground while shoe 10 is in the second position.

In the above-described embodiments, no matter which row of panels is currently engaged with the ground (e.g., angled panel(s) 106*a*, angled panel(s) 106*b*, or flat panel(s) 104), the plurality of panels 102 may be configured such that when the shoe is shifted side to side between a first and second position, the shoe 10 may engage with the ground via a first and second panel along that specific row or set of panels to help keep shoe 10 in a steady and balanced position, while protecting the applicable portion of the heel of the shoe 10 from making contact with the ground, thereby becoming potentially scuffed or scratched. In addition, no matter what angle shoe 10 is placed relative to the ground and/or the vehicle pedals, the plurality of panels 102 may be configured to enable the shoe 10 to "snap" into a safe and comfortable position, e.g., by shifting from panel to panel within a row of panels when moving side to side.

Figure 5:
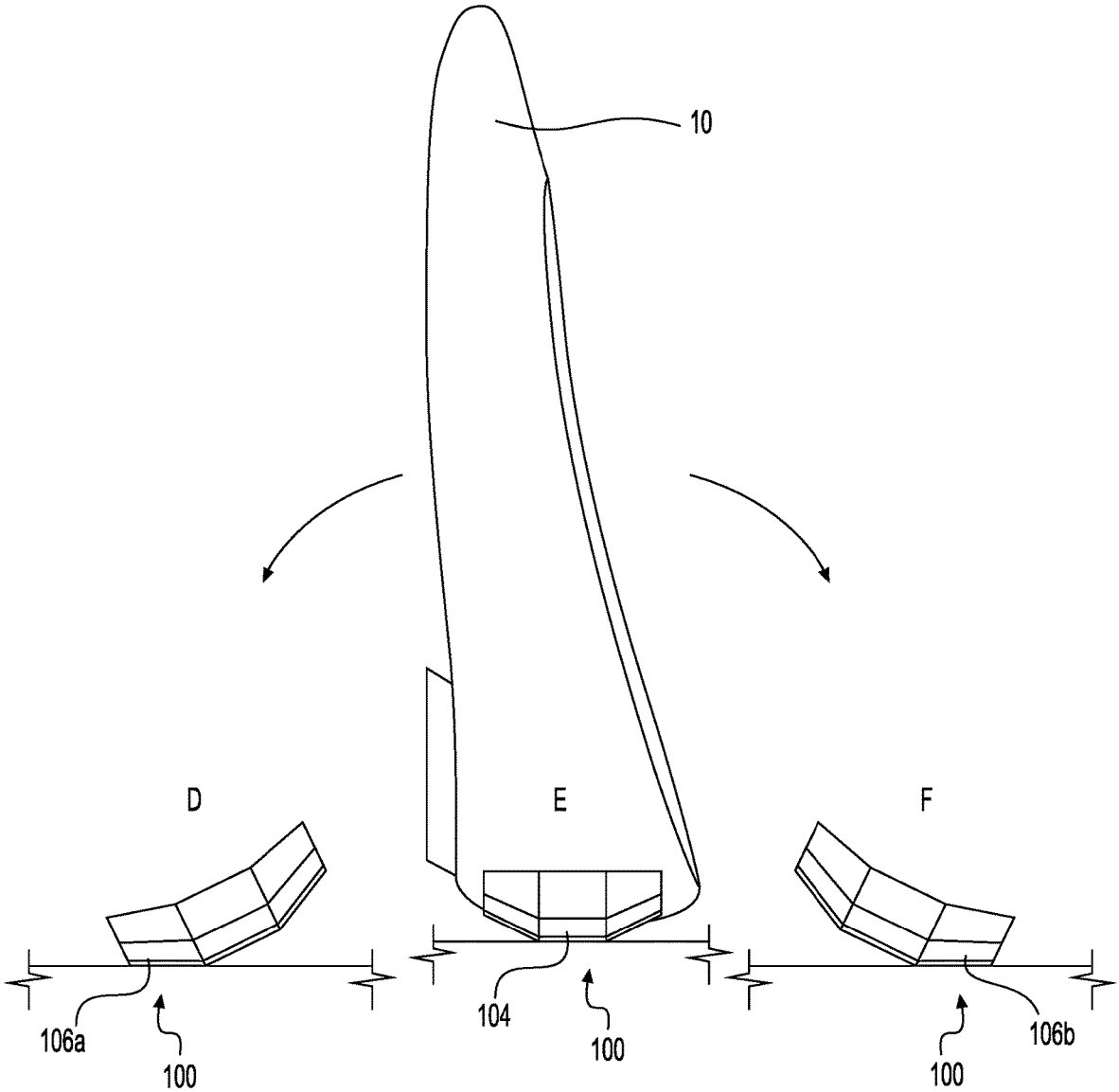
FIG. 5 is a side view of the shoe protector of FIG. 1A used in conjunction with a shoe according to certain embodiments of the present disclosure.

FIG. 5 is a side view of shoe protector 100 used in conjunction with a shoe 10 according to certain embodiments of the present disclosure. FIG. 5 provides an example of how shoe protector 100 may engage with the ground, such as the floor of a vehicle, when shoe protector 100 is used on shoe 10 while a user is driving a vehicle. For example, while driving, a wearer of shoe 10 may have his or her heel resting on the floor of the vehicle, and may move shoe 10 between positions D, E, and/or F, e.g., rotating up and down, when performing certain actions, such as pressing down on and/or letting up on the clutch, accelerator, or brake pedal.

In some embodiments, when shifting from a first position to a second position, e.g., position E to position D, or position E to position F, a first flat panel of the flat panel(s) 104 may engage with the ground while shoe 10 is in the first position, while a first angled panel of the angled panel(s) 106*a* or 106*b* may engage with the ground while shoe 10 is in the second position. For example, when shifting from position E to position D, a first flat panel 104 may engage with the ground in position E, while a first angled panel 106*a* may engage with the ground in position D. Alternatively, when shifting from position E to position F, a first flat panel 104 may engage with the ground in position E, while a first angled panel 106*b* may engage with the ground in position F. In some embodiments, when shifting from a first to a second position, a first angled panel may engage with the ground while shoe 10 is in the first position, such as angled panel 106*a* in position D or angled panel 106*b* in position F, while a first flat panel 104 may engage with the ground while shoe 10 is in the second position, such as position E.

In the above-described embodiments, no matter which row or set of panels is currently engaged with the ground (e.g., angled panel(s) 106*a* in position D, flat panel(s) 104 in position E, or angled panel(s) 106*b* in position F), the plurality of panels 102 may be configured such that when the shoe is shifted up and down between a first and second position, the shoe 10 may engage with the ground via a first panel within a first row, and then a second panel within a second and different row, to help keep shoe 10 in a steady and balanced position, while protecting the applicable portion of the heel of the shoe 10 from making contact with the ground, thereby becoming potentially scuffed or scratched. That is, the plurality of panels 102 may include a row of flat panel(s) 104 such that when the shoe 10 is placed in an approximately straight upward position (e.g., position E), shoe 10 is able to rest flatly against the ground. The plurality of panels 102 may further include a row of angled panel(s) 106*a* and/or 106*b* such that when the shoe 10 is moved up or down from an approximately straight upward position to an angled position, the shoe may "snap" into a safe and comfortable position, e.g., by shifting from a flat panel (e.g., 104) to an angled panel (e.g., 106*a* or 106*b*) allowing shoe 10 to rest flatly against the ground.

The above-described configurations of the plurality of panels 102 may help ensure shoe protector 100 is able to protect shoe 10 from scuffing or scratching, while enabling a wearer of shoe 10 to safety and comfortably drive a vehicle while using shoe protector 100 (and/or shoe protector 200 or 300).

While certain implementations of the disclosed technology have been described in connection with what is presently considered to be the most practical and various implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain implementations of the disclosed technology and also to enable any person skilled in the art to practice certain implementations of the disclosed technology, including making and using any devices or systems and performing any incorporated methods. The patentable scope of certain implementations of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

As used herein, the terms "about" or "approximately" for any numerical values or ranges indicate a suitable dimensional tolerance that allows the part or collection of components to function for its intended purpose as described herein.

In describing example embodiments, terminology has been resorted to for the sake of clarity. It is intended that each term contemplates its broadest meaning as understood by those skilled in the art and includes all technical equivalents that operate in a similar manner to accomplish a similar purpose without departing from the scope and spirit of the invention. It is also to be understood that the mention of one or more steps of a method does not preclude the presence of additional method steps or intervening method steps between those steps expressly identified. Similarly, some steps of a method can be performed in a different order than those described herein without departing from the scope of the disclosed technology. For clarity and conciseness, not all possible combinations have been listed, and such variants are often apparent to those of skill in the art and are intended to be within the scope of the claims which follow.

The invention claimed is:

1. A shoe protector configured to removably adhere to a back portion of a shoe and comprising:

a plurality of panels configured to extend outwardly from the back portion of the shoe, the plurality of panels comprising:

one or more two-dimensional flat panels each configured approximately parallel to the back portion of the shoe and disposed in a continuous row;

one or more first two-dimensional flat angled panels each configured at a respective first angle relative to the back portion of the shoe; and one or more second angled panels each configured at a respective second angle relative to the back portion of the shoe, wherein the one or more first angled panels extend from an upper-most edge of the shoe protector to an upper-most edge of the one or more flat panels, and wherein the one or more second angled panels extend from a lower-most edge of the shoe protector to a lower-most edge of the one or more flat panels.

2. The shoe protector of claim 1, wherein the plurality of panels are configured such that when the shoe is moved from a first position to a second position, either:

a first flat panel of the one or more flat panels engages with the ground in the first position and a second flat panel of the one or more flat panels engages with the ground in the second position; or a first angled panel of the one or more angled panels engages with the ground in the first position and a second angled panel of the one or more angled panels engages with the ground in the second position.

3. The shoe protector of claim 1, wherein the plurality of panels are configured such that when the shoe is moved from a first position to a second position, either:

a first flat panel of the one or more flat panels engages with the ground in the first position and a first angled panel of the one or more angled panels engages with the ground in the second position; or a first angled panel of the one or more angled panels engages with the ground in the first position and a first flat panel of the one or more flat panels engages with the ground in the second position.

4. The shoe protector of claim 1, wherein the one or more first angled panels are configured as a mirror image of the one or more second angled panels.

5. The shoe protector of claim 1, further comprising:

a clip configured to attach to and extend from a first edge of the shoe protector and removably attach to a collar of the shoe behind a heel of a user.

6. The shoe protector of claim 1, further comprising:

a tab configured to aid in removal of the shoe protector from the back portion of the shoe.

7. The shoe protector of claim 6, wherein the tab extends from a first edge of the shoe protector.

8. A shoe protector configured to removably adhere to a back portion of a shoe and comprising:

a plurality of panels configured to extend outwardly from the back portion of the shoe, the plurality of panels comprising:

one or more two-dimensional flat panels each configured approximately parallel to the back portion of the shoe and disposed in a continuous row;

one or more first two-dimensional flat angled panels each configured at a respective first angle relative to the back portion of the shoe; and one or more second angled panels each configured at a respective second angle relative to the back portion of the shoe; and a clip configured to attach to and extend from a first edge of the plurality of panels and removably attach to a collar of the shoe behind a heel of a user, wherein the one or more first angled panels extend from an upper-most edge of the shoe protector to an upper-most edge of the one or more flat panels, and wherein the one or more second angled panels extend from a lower-most edge of the shoe protector to a lower-most edge of the one or more flat panels.

9. The shoe protector of claim 8, wherein the one or more first angled panels are configured as a mirror image of the one or more second angled panels.

10. The shoe protector of claim 8, further comprising:

a tab configured to aid in removal of the shoe protector from the shoe, wherein the tab extends from a first edge of the plurality of panels.

* * * * *